US005378191A

United States Patent [19]

Ryaa

[11] Patent Number: 5,378,191

[45] Date of Patent: Jan. 3, 1995

[54] TOY DEVICE FOR PICKING UP OBJECTS FROM A PLANE FACE

[75] Inventor: Jan Ryaa, Billund, Denmark

[73] Assignee: Interlego AG, Baar, Switzerland

[21] Appl. No.: 70,437

[22] PCT Filed: Dec. 3, 1991

[86] PCT No.: PCT/DK91/00372

§ 371 Date: Jun. 29, 1993

§ 102(e) Date: Jun. 29, 1993

[87] PCT Pub. No.: WO92/10255

PCT Pub. Date: Jun. 25, 1992

[30] Foreign Application Priority Data

Dec. 4, 1990 [DK] Denmark ..... 2874/90

[51] Int. Cl.[6] ..... A63H 33/30; A63H 17/14

[52] U.S. Cl. ..... 446/424; 446/144; 446/427

[58] Field of Search ..... 446/73, 75, 144, 237, 446/269, 424, 427, 465, 487; 56/328.1; 294/19.2

[56] References Cited

U.S. PATENT DOCUMENTS

| | | | |
|---|---|---|---|
| 2,287,133 | 6/1942 | Reiter | 446/427 |
| 2,940,242 | 6/1960 | Patterson | 56/328.1 |
| 2,960,791 | 11/1960 | Reed | 446/144 |
| 3,197,918 | 8/1965 | Coggeshall | 446/290 |
| 3,240,201 | 3/1966 | Shelton | 446/465 |
| 3,308,613 | 3/1967 | Davidson | 56/328.1 |
| 3,777,462 | 12/1973 | Sharp et al. | 56/328.1 |
| 3,862,538 | 1/1975 | Henson | 56/328.1 |
| 3,959,922 | 6/1976 | Leistikow | 46/205 |
| 3,983,662 | 10/1976 | Hart | 46/205 |
| 3,986,324 | 10/1976 | Harriott et al. | 56/328.1 |
| 4,031,659 | 6/1977 | Keller et al. | 446/427 |
| 4,917,648 | 4/1990 | Hartje | 446/424 |

FOREIGN PATENT DOCUMENTS

| | | | |
|---|---|---|---|
| 153054 | 6/1988 | Denmark . | |
| 2558380 | 7/1985 | France | 294/19.2 |
| 2631839 | 12/1989 | France . | |
| 873669 | 4/1953 | Germany . | |
| 426210 | 12/1982 | Sweden . | |
| 662058 | 9/1987 | Switzerland | 294/19.2 |
| 921344 | 3/1963 | United Kingdom . | |

*Primary Examiner*—Max Hindenburg
*Assistant Examiner*—Jeffrey D. Carlson
*Attorney, Agent, or Firm*—Kane, Dalsimer, Sullivan, Kurucz, Levy, Eisele and Richard

[57] ABSTRACT

A toy device picks up objects from a plane surface, where a set of wheels drives rotary blades adapted to move the objects up a guide plate toward a magazine. The blades are relatively stiff and comprise an integral hinge spaced from the axis of rotation of the blade wheel.

10 Claims, 3 Drawing Sheets

TOY DEVICE FOR PICKING UP OBJECTS FROM A PLANE FACE

BACKGROUND OF THE INVENTION

The invention concerns a toy device for picking up objects from a plane face, where a set of wheels drives rotary blades adapted to guide the objects into a magazine in the device.

A plurality of examples of devices of the said type is known, which may in practice be divided into two different categories. The first category comprises i.e. a French patent 2631839, disclosing a unit for collecting tennis balls, which takes place by using plate-shaped blades. An American patent specification U.S. Pat. No. 3,197,918 discloses a toy animal, which "eats" various objects which are moved into a magazine. A British patent GB 921,344 likewise provides an "eating" animal where objects or the "food" is moved into a magazine. An American patent specification U.S. Pat. No. 3,983,662 provides a device for picking up objects such as toys. The device disclosed in said specification has a blade wheel with stiff blades coated with foamed plastics to cushion the forces which the stiff blades impart to the objects upon contact.

It is common to the above-mentioned examples of prior art that all comprise blade wheels with stiff blades, entailing that these devices are only suitable for picking up round objects, since the blade wheel if hitting a box-shaped block will often drive up on the block instead of moving it into the magazine. Thus, these devices are not suitable for picking up building elements of a toy building set when these elements may be box-shaped. Further, the devices have the drawback that their dynamic range, i.e. the difference between the largest and the smallest object which may be picked up with the device, is rather limited.

It has been attempted to compensate this in a plurality of other patent specifications belonging to the second category; an example of these is an American patent specification U.S. Pat. No. 3,959,922 which provides a device for picking up objects, such as toys. The blade wheel is here made of a soft, spongy material. A German patent specification DE 873 669 describes how the toy may be picked up with a device having a brush mounted rotatably about a horizontal axis for moving the toy into a magazine. A toy car with a blade wheel having soft and relatively thick blades is described in a Danish patent specification DK 153 054. It is common to this second category of devices for picking up objects from a plane face that a horizontally positioned blade wheel with blades of soft, spongy or porous materials is provided at the front of the device. This has the drawback that the blades will rapidly be worn and destroyed. Further materials of this type are difficult to clean, so that, in addition to the limited durability, also the difficult cleaning must be mentioned as one of the drawbacks.

SUMMARY OF THE INVENTION

The object of the invention is to provide a toy device for picking up objects from a plane surface and moving them to a magazine, where the device must be capable of picking up objects having widely different sizes and shapes by means of a blade wheel, and the blades of the blade wheel must simultaneously be solid and so shaped that the device can pick up box-shaped blocks, even if a rotary blade wheel hits a block from above.

This object is achieved according to the invention in that each blade is formed of a relatively stiff material and comprises an integral hinge spaced from the axis of rotation of the blade wheel. As long as it does not encounter serious resistance from the objects to be picked up, a blade having such an integral hinge will operate like the stiff blade wheel according to the prior art, while the integral hinge will contribute with its effect when a blade is loaded substantially when contacting an object to be picked up.

This load may be that a blade hits a box-shaped block from above. In the prior art, the vehicle would lift, but the integral hinge here entails that a blade will bend and move past the object which will then be guided to the magazine by the next blade.

The integral hinge is preferably formed in parallel with the axis of rotation of the blade wheel, but in some cases, e.g. if the blade wheel is divided into two parts in an axial direction, it may be expedient to form the integral hinge so as to provide a reverse snow-plow effect, i.e. large objects are moved towards the center of the toy device when contacting the blades. Each blade may be provided with several radially spaced integral hinges so that the blade will be resilient. The integral hinge preferably consists in a longitudinal weakening which, to reinforce the hinge and counteract nick formation, is terminated in a bead at the ends of the blade, the bead forming a reinforced portion of material between the blade parts divided by the integral hinge.

The blade wheel moves the objects into the magazine via a guide plate substantially following the curvature of the blade wheel. If a block is about to become jammed between a blade wheel and the lower part of this guide plate, the integral hinge entails that the object will be subjected to an upwardly directed force since the point of attack on the blade plate is brought closer to the axis of rotation of the blade wheel as the integral hinge is bent. This effect is increased if the blades, at least in the areas contacting objects, have friction increasing means. These means may be areas with grooves in the axial direction of the blade or may consist in a rubber coating on part of the blade.

The guide plate may advantageously be mounted resiliently so that it may be displaced from a position of rest in a direction which substantially follows the movement of the blade wheel. This together with the operation of the integral hinge counteracts Jamming of objects between the guide plate and the tip of a blade. For reasons of production, the driving wheel set often constitutes an integral part of the blade wheel and defines it at the sides.

BRIEF DESCRIPTION OF THE DRAWINGS

The invention will be explained more fully below with reference to the drawing, in which.

DETAILED DESCRIPTION OF THE INVENTION

Figure 1:
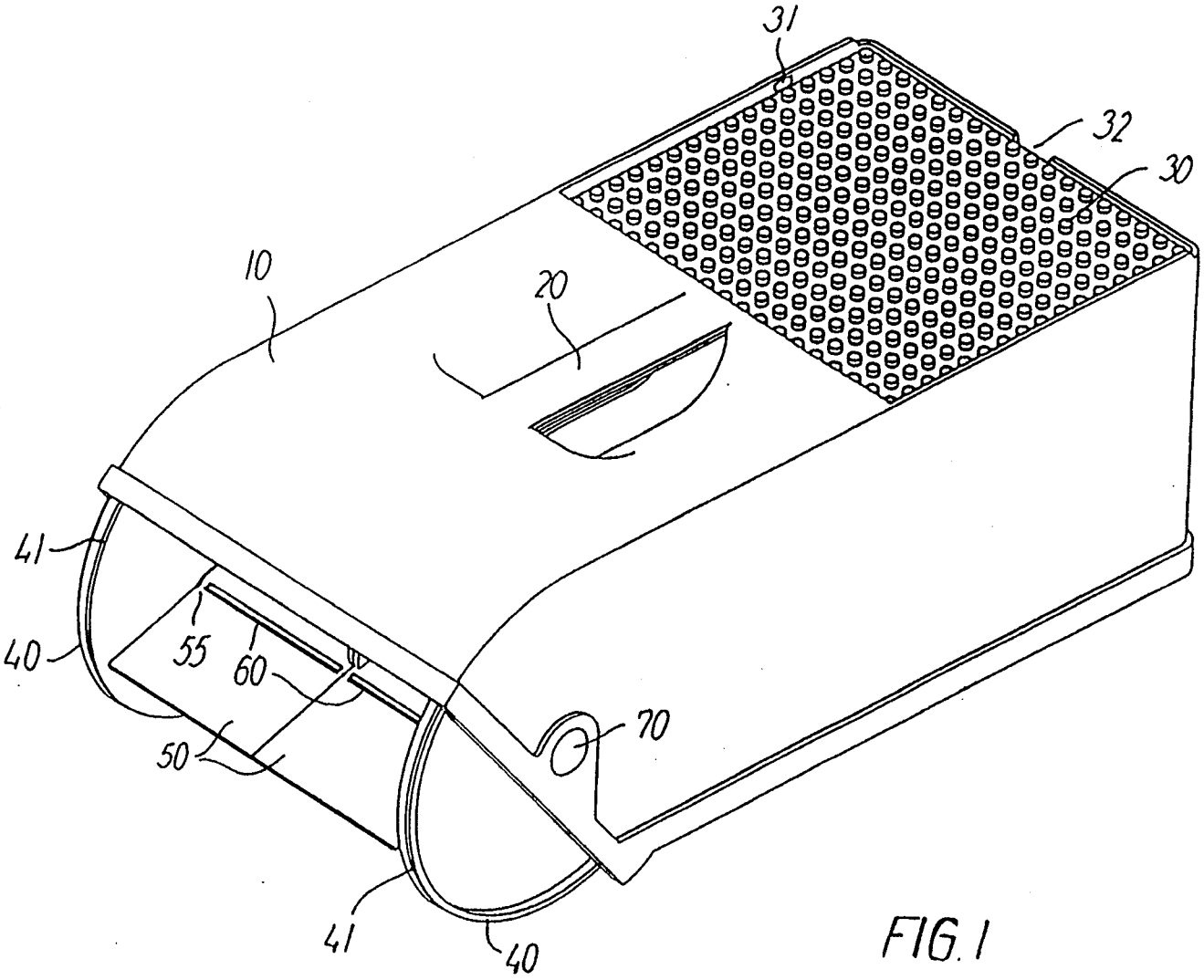
FIG. 1 is a perspective view of a preferred embodiment of a toy device according to the invention.

A toy device shown in FIG. 1 comprises a housing 10 which is box-shaped in the preferred embodiment and is adapted to be moved forward on a set of wheels 40 at the front end of the housing and one or more slide knobs (not shown) at the rear end of the housing. Upwardly the housing has a handle 20 with which a playing child can have a good grip on the toy device. The handle 20 extends like a bridge over a depression in the upper side of the housing. The rear end of the actual housing serves as a magazine for collected toys, which will be explained more fully below. Access to the magazine is ensured through a removable door 30 engaging round its edge inwardly extending flanges on the walls of the housing 10. The plate 30 is retained in a closed position by a plurality of knobs 31, so that the plate 30 may advantageously be made of an elastic material so that its resilient properties may be used for moving the plate 30 past the knobs 31. The rear wall of the housing 10 upwardly has a centrally provided opening or depression 32 by means of which a user can grip below the plate 30, When the objects to be picked up are formed by building elements from a toy building set, the plate 30 may advantageously be formed with coupling studs on the upper side so that the plate may be built together with These building elements.

At its front end the housing 10 has a horizontally arranged blade wheel which may be rotated about a horizontal shaft 70. The blade wheel has a plurality of radially protruding blades 50. The blade wheel may advantageously be integral with the wheel set 40 and thus follows the rotation of the wheels. The preferred embodiment comprises precisely five sets of blades 50 extending radially from the shaft 70, Each of these blades has an integral hinge formed at a distance from the axes of rotation of the blade wheel. The wheels 40 may be formed with a rubber ring or a rubber coating 41 on their rolling face so that the toy device has a better grip on the base.

Figure 2:
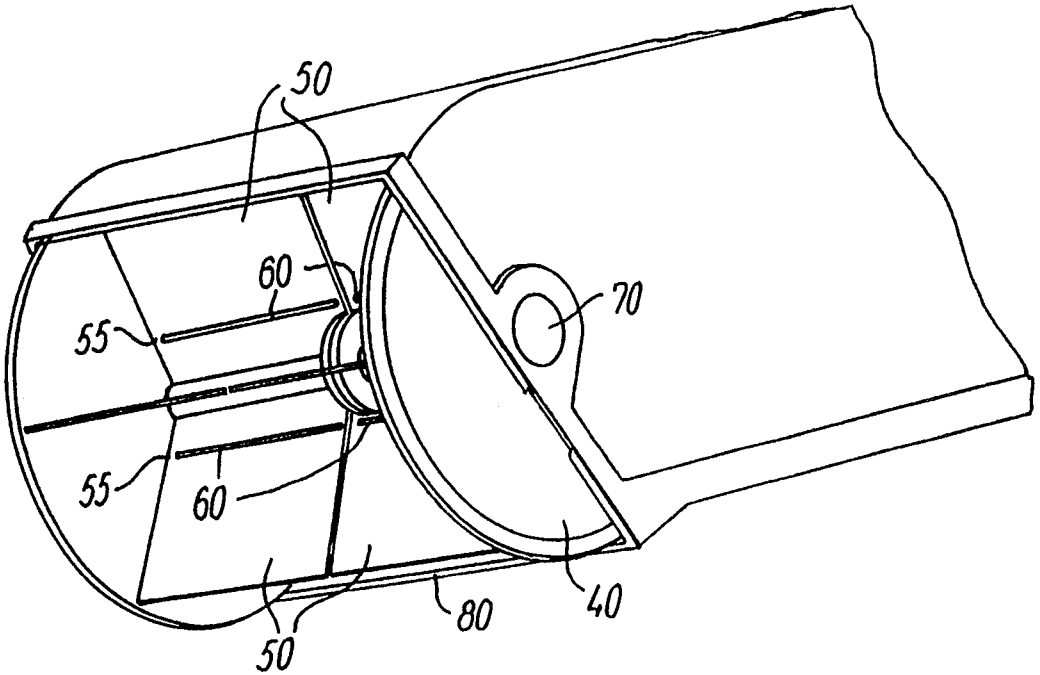
FIG. 2 is a perspective view of the blade wheel and the guide plate in the device shown in FIG. 1.

FIG. 2 shows the blade wheel and a guide plate 80 arranged behind the blade wheel in the housing 10 and along which objects picked up by the blade wheel are moved to the magazine in the housing 10 disposed behind the guide plate. The blade wheel in this case has four set of blades. It will be seen that in the axial direction the blade wheel is divided into two blade sections. i.e. is divided in the center. The wheel set 40 also constitutes an integral part of the blade wheel through the shaft 70. Thus, the blade wheel is driven directly by the rotation of the wheel set 40. Each integral hinge 60 here extends in parallel with the shaft 70 of the blade wheel and is formed by a weakening in the blade 50. This weakening will usually be in the form of a thickness reduction, but may also be provided by punching portions of material along the line formed by the integral hinge, so that the two parts of the blade are connected by a plurality of bridges transversely To the integral hinge 60. With a continuous reduction in thickness the integral hinge 60, however, tends to cause breaks (nick formation) at the ends of the blades, but this may be avoided by terminating the thickness reduction in a bead 55. Such a bead, which connects the two parts of the blade divided by the integral hinge 60, effectively prevents such nick formation.

A wheel 40 will usually only be contiguous with the blade wheel through the shaft 70, but it may be considered expedient in some cases that also the blade part positioned between the integral hinge 60 and the shaft 70 is contiguous with The inner side of the wheel. The guide plate 80 will usually follow the contour of the blade wheel, but this is not necessary if a sufficiently high speed is imparted To an object when contacting a blade 50, so that the object will be able to pass a guide plate 80 after having contacted the blade only once.

Figure 3:
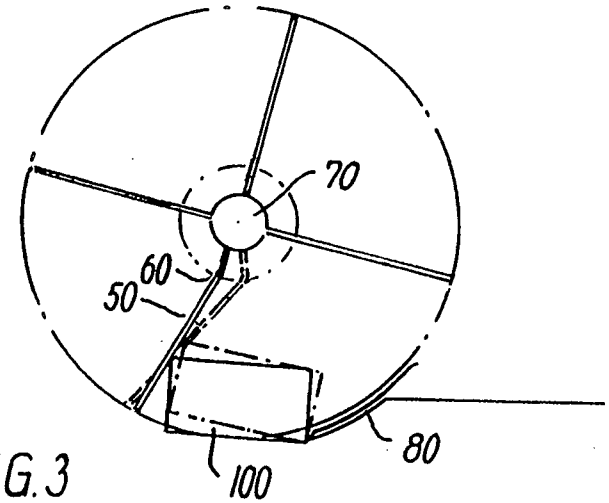
FIG. 3 is a schematic view of the operation of an integral hinge of a blade wheel.

The resilient properties of the individual blade 50 are determined by the length of the integral hinge 60, the shape of the integral hinge 60 as well as the selection of material. FIG. 3 schematically shows the hinge upon contact with a relatively large, box-shaped object 100. It will be seen that a blade 50 will bend about the integral hinge 60 when a box-shaped object 100 is present between the guide plate 80 and the blade 50. As indicated in broken line, the rotation of the blade wheel continues, which results in further bending of the blade 50 about the integral hinge 60. In case of sufficient friction between the object 100 and the contact area on the blade 50, the object 100, as shown in dotted line, will follow the movement of the blade 50 and be tilted about the contact point with the guide plate 80. The object 100 can hereby be moved up the guide plate 80 and into the magazine.

Figure 5:
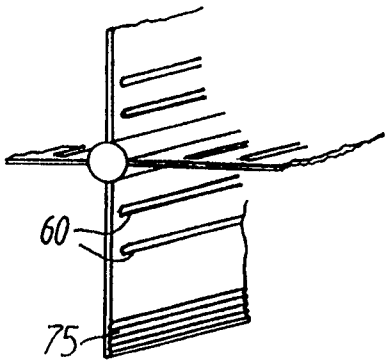
FIG. 5 shows a third embodiment of a blade according to the invention.
Figure 4:
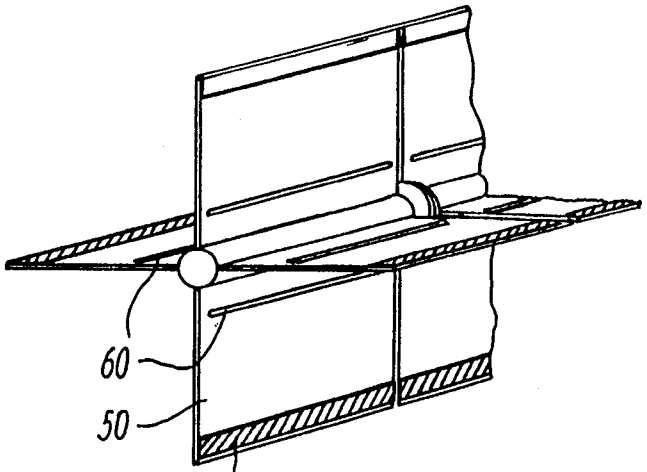
FIG. 4 shows an alternative embodiment of the blades according to the invention.

If the material of which the blade wheel is manufactured does not provide sufficient friction between the object 100 and the blade 50, the friction properties of the blade may be improved by providing the blade with friction increasing means in the contact area, e.g. in the form of a rubber coating 90, which appears from FIG. 4. FIG. 5. shows how the friction increasing means may be formed by grooves 75 in the axial direction of the blade wheel.

Figure 6:
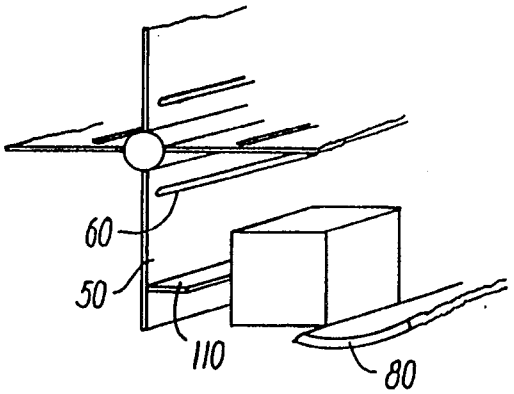
FIG. 6 shows a fourth embodiment of a blade according to the invention.

Small objects usually pose no problems when picked up to the magazine, since the blade wheel, because of the horizontal distance of the shaft 70 from the front edge on the guide plate 80, will impart a substantially horizontal force to these small objects toward the guide plate 80 and up said plate. These small objects will therefore not be able to bend the individual blades 50 about the integral hinge 60, so the blade wheel will operate as if it just had stiff blades 50. Large objects, which are e.g. larger than the horizontal distance between the shaft 70 and the front edge of the guide plate 80, will be caused to contact both the guide plate 80 and the blade 50 before the blade 50 reaches a vertical position, so that the object 100 will be affected by a not insignificant force in a downward direction, and such an object 100 will therefore with great probability be jammed between the guide plate and a blade according to the prior art. This may be obviated by providing the blade 50 with friction coatings 90, 75, optionally with additional integral hinges so that greater bending may be achieved. FIG. 6 shows another solution to this problem where the blade 50, in the contact area with the large block 100, is formed with a flange 110 in the axial direction of the blade and perpendicularly to it. The object 100 will thereby be subjected to a force at a relatively high place so that the object 100 will tilt about the front edge of the guide plate 80 and up said plate.

Figure 7:
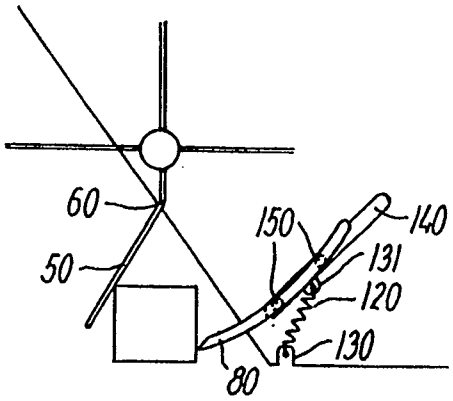
FIG. 7 is a schematic view of an embodiment with a resilient guide plate according to the invention.

FIG. 7 shows an alternative embodiment where a blade wheel has a plurality of blades 50 with integral hinges in an axial direction. The blades 50 move the objects up a guide plate 80. To prevent the object 100 from getting jammed between the blade 50 and the guide plate 80, the guide plate 80 is mounted to be resilient with pins 150 at each side which are adapted to run in guide tracks 140 in the walls of the housing 10. The housing 10 is formed with an eye 130 at the bottom, and a corresponding eye 131 is formed on the rear side of the guide plate 80, so that the guide plate 80 may be displaced along the track 140 under the action of a force from a spring 120 tensioned between the eyes 130 and 131. The guide plate 80 may thus be displaced from a position of rest in a direction substantially following the movement of the blade wheel under the action of a force increasing with the distance from the position of rest.

The position of the integral hinge on a blade is determined by the size of the largest object which the blade wheel must be capable of picking up. The distance between the integral hinge and the tip of a blade must be so great that the largest object to be picked up must be capable of bending the blade about the integral hinge. In the preferred embodiment the blade wheel is composed of two sections in an axial direction, but also this number depends upon the size of the objects to be picked up.

Since the integral hinge 60 is spaced from the axis of rotation of the blade wheel, a blade when bent will apply a pull-force to an object in a direction toward the integral hinge. The toy device of the invention will hereby be able to move large box-shaped objects into the magazine, so that the dynamic range of the toy device is increased considerably over the prior art. By dynamic range is meant the difference between the largest and the smallest block which the device is able to pick up.

The invention has been described in connection with a magazine inside the device, but nothing prevents the device from being formed with a platform to which the objects are moved.

I claim:

1. A toy device for picking up objects from a plane face, said device comprising a housing; a set of wheels (40) mounted for rotation to said housing blades (50) mounted for rotation to said housing to rotate with said wheels and extending partially into said housing, a magazine disposed within said housing in a position whereby rotation of said blades (50) guides the objects into said magazine, said blades consisting of a relatively stiff material, and wherein each blade comprises an integral hinge that pivots about a discrete line (60) spaced from the axis of rotation of the blade.

2. A toy device according to claim 1, and wherein the integral hinge (60) extends in parallel with the axis of rotation.

3. A toy device according to claim 1, and wherein each blade (50) has more than one integral hinge (60).

4. A toy device according to claim 1 wherein said integral hinge divides said blade into two plate-shaped parts and wherein a reinforcement in the form of a bead (55) is provided between the plate-shaped parts of each blade at one end of said integral hinge.

5. A toy device according to claim 1, and wherein the blades (50) have friction increasing means (90, 95) at least in the areas which are caused to contact the objects.

6. A toy device according to claim 5, and wherein the blades rotate about an axis of rotation and the friction increasing means are areas with grooves (95) extending parallel to said rotational axis of the blades.

7. A toy device according to claim 5, and wherein the blades (50) are provided with a rubber coating (90) in the areas caused to contact the objects.

8. A toy device according to claim 1, and wherein a guide plate (80) is formed adjacent the blades (50) and is constructed so that the guide plate (80) substantially follows the curvature of the blade wheel, whereby the blades can move an object (100) up the guide plate (80) from the plane face towards the magazine.

9. A device according to claim 8, and wherein the guide plate (80) is mounted to be resilient so that it may be displaced from a position of rest in a direction substantially following the movement of the blades under the action of a force increasing with the distance from the position of rest.

10. A device according to claim 1, and wherein the set of wheels (40) constitutes an integral part of the blades and defines the sides of the blades.

* * * * *